United States Patent [19]

Aldridge et al.

[11] 4,077,867

[45] Mar. 7, 1978

[54] HYDROCONVERSION OF COAL IN A HYDROGEN DONOR SOLVENT WITH AN OIL-SOLUBLE CATALYST

[75] Inventors: Clyde L. Aldridge; Roby Bearden, Jr., both of Baton Rouge, La.

[73] Assignee: Exxon Research & Engineering Co., Linden, N.J.

[21] Appl. No.: 702,272

[22] Filed: Jul. 2, 1976

[51] Int. Cl.[2] ..... C10G 1/08

[52] U.S. Cl. ..... 208/10

[58] Field of Search ..... 208/10

[56] References Cited

U.S. PATENT DOCUMENTS

| | | | |
|---|---|---|---|
| 3,502,564 | 3/1970 | Hodgson | 208/10 |
| 3,532,617 | 10/1970 | Hodgson | 208/10 |
| 3,687,838 | 8/1972 | Seitzer | 208/10 |
| 3,813,329 | 5/1974 | Gatsis | 208/10 |
| 3,920,536 | 11/1975 | Seitzer et al. | 208/10 |

*Primary Examiner*—Delbert E. Gantz
*Assistant Examiner*—James W. Hellwege
*Attorney, Agent, or Firm*—Marthe L. Gibbons

[57] ABSTRACT

A process for catalytically hydroconverting coal to produce coal liquids is effected by forming a mixture of an oil soluble metal compound, a hydrogen donor solvent and coal, converting the compound to a catalyst within said mixture and reacting the mixture with hydrogen. The recovered hydrogen donor solvent may be recycled to the hydroconversion zone without intervening hydrogenation. Preferred compounds are molybdenum compounds.

31 Claims, 4 Drawing Figures

EFFECT OF COAL SLURRY CONCENTRATION ON LIQUEFACTION

HYDROGEN CONSUMPTION

HYDROCONVERSION OF COAL IN A HYDROGEN DONOR SOLVENT WITH AN OIL-SOLUBLE CATALYST

BACKGROUND OF THE INVENTION

1. Field of the Invention

This invention relates to a process for hydroconverting coal in a hydrogen donor solvent to liquid hydrocarbon products in the presence of a catalyst prepared in situ from a small amount of metals added to the mixture of coal and solvent as oil soluble metal compounds.

2. Description of the Prior Art

Hydroconversion of coal to coal liquids in a hydrogen donor solvent process is well known. In such a process, a slurry of coal in a hydrogen donor solvent is reacted in the presence of molecular hydrogen at elevated temperature and pressure. See, for example, U.S. Pat. No. 3,645,885, the teachings of which are hereby incorporated by reference. The hydrogen donor solvent which becomes hydrogen depleted during the coal liquefaction reaction, in the prior art processes, is generally subjected to a hydrogenation stage prior to its being recycled to the hydroconversion zone.

It is also known to convert coal to liquid products by hydrogenation of coal which has been impregnated with an oil-soluble metal naphthenate or by hydrogenation of coal in a liquid medium such as an oil having a boiling range of 250° to 325° C. containing an oil-soluble metal naphthenate, as shown in Bureau of Mines Bulletin No. 622, published 1965, entitled "Hydrogenation of Coal in Batch Autoclave", pages 24 to 28. Concentrations as low as 0.01% metal naphthenate catalysts, calculated as the metal, were found to be effective for the conversion of coal. U.S. Pat. Nos. 3,532,617 and 3,502,564 also disclose the use of metal naphthenates in coal hydroconversion.

U.S. Pat. No. 3,920,536 discloses a process for the liquefaction of subbituminous coal in a hydrogen donor oil in the presence of hydrogen, carbon monoxide, water, and an alkali metal or ammonium molybdate in an amount ranging from 0.5 to 10 percent by weight of the coal.

It has now been found that hydrogen depletion of the hydrogen donor solvent in the coal hydroconversion zone (liquefaction zone) can be minimized and the necessity for rehydrogenating the used hydrogen donor solvent can be reduced or omitted when the hydroconversion reaction is conducted in the presence of a minor amount of a catalyst produced from an added oil-soluble metal compound.

Additional advantages in the utilization of oil-soluble metal compounds in a hydrogen donor solvent coal liquefaction process will become apparent in the following description.

The term "hydroconversion" with reference to coal is used herein to designate a catalytic conversion of coal to liquid hydrocarbons in the presence of hydrogen.

SUMMARY OF THE INVENTION

In accordance with the invention, there is provided, a process for hydroconverting coal to produce an oil, which comprises: (a) forming a mixture of coal, a hydrogen donor solvent and an added oil-soluble metal compound, said metal being selected from the group consisting of Groups VB, VIB, VIIB and VIII of the Periodic Table of Elements and mixtures thereof; (b) converting said oil-soluble compound to a catalyst within said mixture in the presence of a hydrogen-containing gas; (c) reacting the resulting mixture containing said catalyst with a hydrogen-containing gas under coal hydroconversion conditions in a hydroconversion zone; (d) removing from said hydroconversion zone an effluent comprising an oil product and solids; (e) separating said oil product into a light fraction, an intermediate fraction and a heavy fraction; (f) recycling, without intervening hydrogenation, at least a portion of said intermediate fraction as solvent to said hydroconversion zone.

In accordance with another embodiment of the invention, there is provided a process for hydroconverting coal to produce an oil, which comprises: (a) forming a mixture of wet coal, a hydrogen donor solvent and an added oil-soluble metal compound, said oil-soluble metal compound being added in an amount ranging from about 10 to about 700 wppm, calculated as the elemental metal, based on the weight of coal in said mixture, said metal being selected from the group consisting of Groups VB, VIB, VIIB and VIII of the Periodic Table of Elements and mixtures thereof; (b) converting said oil-soluble metal compound to a catalyst within said mixture in the presence of a hydrogen-containing gas; (c) reacting the resulting mixture containing said catalyst with a gas comprising hydrogen and from about 5 to about 50 mole percent carbon monoxide, under coal hydroconversion conditions, in a hydroconversion zone; and (d) recovering an oil product.

DESCRIPTION OF THE PREFERRED EMBODIMENTS

The process of the invention is generally applicable to hydroconvert coal to produce coal liquids (i.e. normally liquid hydrocarbon products) in a hydrogen donor solvent process. The term "coal" is used herein to designate a normally solid carbonaceous material including all ranks of coal, such as anthracite coal, bituminous coal, semibituminous coal, subbituminous coal, lignite, peat and mixtures thereof.

Figure 1:
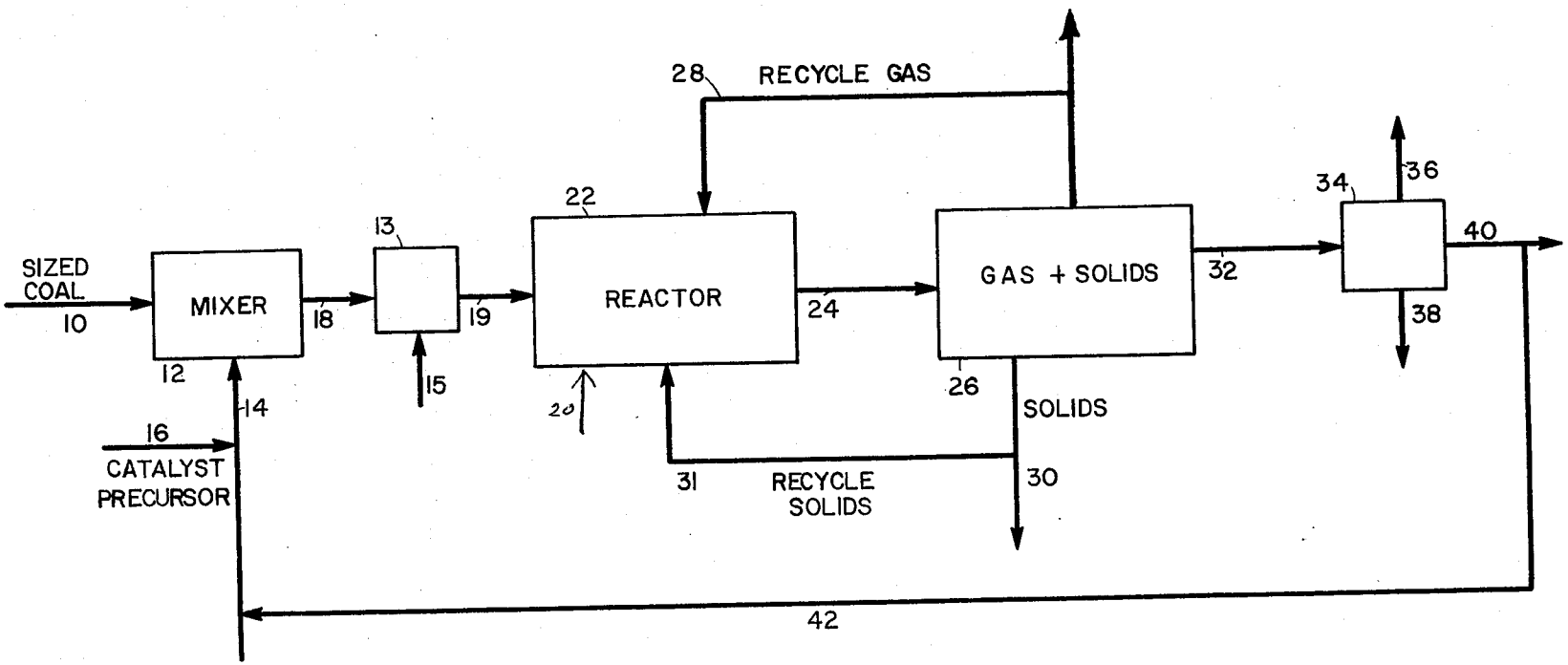
FIG. 1 is a schematic flow plan of one embodiment of the invention.

In the process shown in FIG. 1, the coal, in particulate form, of a size ranging up to about one eighth inch particle size diameter, suitably 8 mesh (Tyler) is introduced by line 10 into a mixing zone 12 in which it is mixed with a hydrogen donor solvent introduced by line 14. The solvent and coal are admixed in a solvent-to-coal weight ratio ranging from about 0.8:1 to 4:1, preferably from about 1:1 to 2:1.

The hydrogen donor solvent employed will normally be an intermediate stream boiling between 350° F. (176.67° C.) and about 800° F. (426.67° C.), preferably between about 400° F. (204.44° C.) and about 700° F., (371.11° C.) derived from a coal liquefaction process. This stream comprises hydrogenated aromatics, naphthenic hydrocarbons, phenolic materials and similar compounds and will normally contain at least 30 wt. %, preferably at least 50 wt. % of compounds which are known to be hydrogen donors under the temperature and pressure conditions employed in the hydroconversion (i.e. liquefaction) zone. Other hydrogen-rich solvents may be used instead of or in addition to such coal derived liquids, particularly on initial start up of the process. Suitable aromatic hydrogen donor solvents include hydrogenated creosote oil, hydrogenated intermediate product streams from catalytic cracking of petroleum feedstocks, and other coal-derived liquids which are rich in indane, $C_{10}$ to $C_{12}$ tetralins, decalins, biphenyl, methylnaphthalene, dimethylnaphthalene, $C_{12}$ and $C_{13}$ acenaphthenes and tetrahydroacenaphthene and similar donor compounds. An oil-soluble metal compound wherein the metal is selected from the group consisting of Groups VB, VIB, VIIB, VIII and mixtures thereof of the Periodic Table of Elements is added to the hydrogen donor solvent by line 16 so as to form a mixture of oil soluble metal compound, hydrogen donor solvent and coal in mixing zone 12. The oil-soluble metal compound is added in an amount sufficient to provide from about 10 to less than 2000 wppm, preferably from about 25 to 950 wppm, more preferably, from about 50 to 700 wppm, most preferably from about 50 to 400 wppm, of the oil-soluble metal compound, calculated as the elemental metal, based on the weight of coal in the mixture.

Suitable oil-soluble metal compounds convertible to active catalysts under process conditions include (1) inorganic metal compounds such as halides, oxyhalides, hydrated oxides, heteropoly acids (e.g. phosphomolybdic acid, molybdosilisic acid); (2) metal salts of organic acids such as acyclic and alicyclic aliphatic carboxylic acids containing two or more carbon atoms (e.g. naphthenic acids); aromatic carboxylic acids (e.g. toluic acid); sulfonic acids (e.g. toluenesulfonic acid); sulfinic acids; mercaptans, xanthic acid; phenols, di and polyhydroxy aromatic compounds; (3) organometallic compounds such as metal chelates, e.g. with 1,3-diketones, ethylene diamine, ethylene diamine tetraacetic acid, phthalocyanines, etc.; (4) metal salts of organic amines such as aliphatic amines, aromatic amines, and quaternary ammonium compounds.

The metal constituent of the oil soluble metal compound is selected from the group consisting of Groups VB, VIB, VIIB and VIII of the Periodic Table of Elements, and mixtures thereof, in accordance with the table published by E. H. Sargent and Company, copyright 1962, Dyna Slide Company, that is, vanadium, niobium, tantalum, chromium, molybdenum, tungsten, manganese, rhenium, iron, cobalt, nickel, and the noble metals including platinum, iridium, palladium, osmium, ruthenium and rhodium. The preferred metal constituent of the oil soluble metal compound is selected from the group consisting of molybdenum, vanadium and chromium. More preferably, the metal constituent of the oil soluble metal compound is selected from the group consisting of molybdenum and chromium. Most preferably, the metal constituent of the oil soluble metal compound is molybdenum. Preferred compounds of the metals include the salts of acyclic (straight or branched chain) aliphatic carboxylic acids, salts of alicyclic aliphatic carboxylic acids, heteropolyacids, hydrated oxides, carbonyls, phenolates and organo amine salts. More preferred types of metal compounds are the heteropoly acid, e.g. phosphomolybdic acid. Another preferred metal compound is a salt of an alicyclic aliphatic carboxylic acid such as the metal naphthenate. The most preferred compounds are molybdenum naphthenate, vanadium naphthenate and chromium naphthenate.

When the oil-soluble metal compound is added to the hydrogen donor solvent, it dissolves in the solvent. To form the catalyst, the metal compound (catalyst precursor) is converted within the slurry of coal and hydrogen donor solvent.

Various methods can be used to convert the dissolved metal compound in the coal-solvent slurry to an active catalyst. A preferred method (pretreatment method) of forming the catalyst from the oil-soluble compound of the present invention is to heat the mixture of metal compound, coal and solvent to a temperature ranging from about 325° C. to about 415° C. and at a pressure ranging from about 500 to about 5000 psig, in the presence of a hydrogen-containing gas.

Preferably the hydrogen-containing gas also comprises hydrogen sulfide. The hydrogen sulfide may comprise from about 1 to about 90 mole percent, preferably from about 1 to about 50 mole percent, more preferably from about 1 to 30 mole percent of the hydrogen-containing gas mixture. The pretreatment is conducted for a period ranging from about 5 minutes to about 2 hours, preferably for a period ranging from about 10 minutes to about 1 hour. The thermal treatment in the presence of hydrogen or in the presence of hydrogen and hydrogen sulfide is believed to facilitate conversion of the metal compound to the corresponding metal-containing active catalysts which act also as coking inhibitors.

The coal-hydrogen donor slurry containing the resulting catalyst is then introduced into a hydroconversion zone which will be subsequently described.

Another method of converting the oil-soluble metal compound of the present invention is to react the mixture of metal compound, coal and hydrogen donor solvent with a hydrogen-containing gas at hydroconversion conditions to produce a catalyst in the chargestock, in situ, in the hydroconversion zone. The hydrogen-containing gas may comprise from about 1 to about 30 mole percent hydrogen sulfide.

Whatever the exact nature of the resulting conversion products of the given oil-soluble metal compound, the resulting metal component is a catalytic agent and a coking inhibitor.

In the process shown in FIG. 1, the mixture of oil-soluble metal compound, hydrogen donor solvent and coal is removed from mixing zone 12 by line 18 and introduced into pretreatment zone 13 into which a gaseous mixture comprising hydrogen and from about 1 to about 90 mole percent, preferably from about 1 to 50 mole percent, more preferably from about 1 to 30 mole percent hydrogen sulfide is introduced by line 15. The pretreatment zone is maintained at a temperature ranging from about 342° C. to about 400° C. and at a total pressure ranging from about 500 to about 5000 psig. The pretreatment is conducted for a period of time ranging from about 10 minutes to about 1 hour. The pretreatment zone effluent is removed by line 19. If desired, a portion of the hydrogen sulfide may be removed from the effluent. The pretreatment zone effluent is introduced by line 19 into hydroconversion reactor 22. A hydrogen-containing gas is introduced into hydroconversion reactor 22 by line 20. Suitable hydrogen-containing gas mixtures for introduction into the hydroconversion zone include raw synthesis gas, that is, a gas containing hydrogen and from about 5 to about 50, preferably from about 10 to 30 mole percent carbon monoxide.

When wet coal (i.e. coal particles associated with water) is utilized as feed, it is particularly desirable to utilize a raw synthesis gas, that is, a gas comprising hydrogen and carbon monoxide. In such an embodiment, the metal compound, preferably a metal-containing organic compound, is added in an amount ranging from 10 to 700 wppm, preferably from 50 to 500 wppm, calculated as the elemental metal, based on the coal alone. The gas introduced by line 20 may additionally contain hydrogen sulfide in an amount ranging from about 1 to 30 mole percent.

The hydroconversion zone is maintained at a temperature ranging from about 343° to 538° C. (649.4° to 1000° F.), preferably from about 416° to 468° C. (780.8° to 899.6° F.), more preferably from about 440° to 468° C. (824° to 875° F.), and a hydrogen partial pressure ranging from about 500 psig to about 5000 psig, preferably from about 1000 to about 3000 psig. The space velocity defined as volumes of the mixture of coal and solvent feedstock per hour per volume of reactor (V/Hr./V) may vary widely depending on the desired conversion level. Suitable space velocities may range broadly from about 0.1 to 10 volumes feed per hour per volume of reactor, preferably from about 0.25 to 6 V/Hr./V, more preferably from about 0.5 to 2 V/Hr./V. The hydroconversion zone effluent is removed from the zone by line 24.

The effluent comprises gases, an oil product and a solid residue which is catalytic in nature. The effluent is passed to a separation zone 26 from which gases are removed overhead by line 28. This gas may be scrubbed by conventional methods to remove any undesired amount of hydrogen sulfide and carbon dioxide and thereafter it may be recycled into the hydroconversion zone. The solids may be separated from the oil product by conventional means, for example, by settling or centrifuging or filtration of the oil-solids slurry. The separated solids are removed from separation zone 26 by line 30. If desired at least a portion of the separated solids or solids concentrate may be recycled directly to the hydroconversion zone via line 31 or recycled to the coal-solvent chargestock.

The remaining portion of solids removed by line 30 may be discarded as such since normally they do not contain economically recoverable amounts of char. The oil product is removed from separation zone 26 by line 32 and passed to a fractionation zone 34 wherein a light fraction boiling below about 400° F. (204.44° C.) is recovered by line 36. A heavy fraction is removed by line 38 and an intermediate range boiling fraction, that is, a fraction boiling from about 400° to about 700° F. (204.44° to 371.11° C.) at atmospheric pressure is recovered by line 40. If desired, this intermediate fraction may be used as the hydrogen donor solvent. In a preferred embodiment of the present invention, at least a portion of the intermediate fraction is recycled via line 42, preferably without any intervening rehydrogenation, into mixing zone 12 or directly into the hydroconversion reaction zone. This is possible because in the process of the present invention the depletion of the hydrogen donor solvent during the hydroconversion reaction is minimized since the presence of the catalyst is believed to cause the molecular hydrogen present in that zone to react with the solvent and therefore maintain the solvent in a hydrogenated condition.

It should also be noted that in non-catalyzed hydrogen donor coal liquefaction processes, the heavy bottoms product resulting from fractional distillation of the coal liquefaction oil product contains solids. The solids-containing heavy bottoms fraction is typically subjected to a fluid coking operation since a substantial portion of the carbon of the chargestock emerges with the solids in the form of char that must be recovered. In contrast, in the process of the present invention, since the solid residue of the liquefaction zone does not contain any significant amount of char, the solids can be separated from the hydroconversion zone effluent by known means and discarded or used as catalyst. The process of the present invention would permit the elimination of the coking step.

Figure 2:
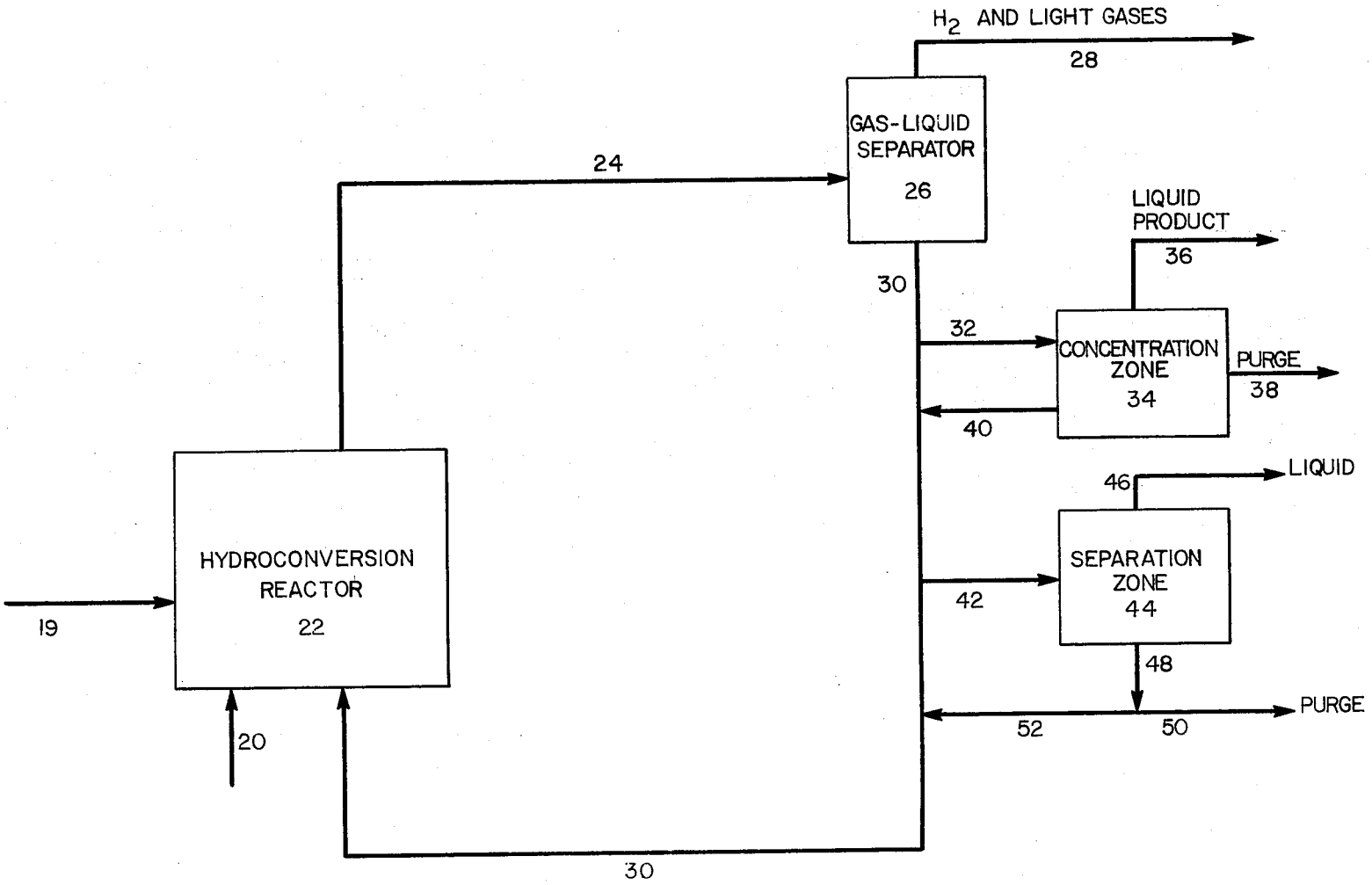
FIG. 2 is a schematic flow plan of another embodiment of the invention.

FIG. 2 shows various process options for treating the hydroconversion reaction zone effluent which is removed from the hydroconversion reactor 22 by line 24. The effluent is introduced into a gas-liquid separator 26 where hydrogen and light hydrocarbons are removed overhead by line 28. Three preferred process options are available for the liquid stream containing dispersed catalyst solids which emerge from separator vessel 26 via line 30.

In process option to be designated "A", the liquid-solids stream is fed by line 32 to concentration zone 34 where by means, for example, of distillation, solid precipitation or centrifugation, the stream is separated into a clean liquid product, which is withdrawn through line 36, and a concentrated slurry (i.e. 20 to 40 percent by weight) in oil. At least a portion of the concentrated slurry can be removed as a purge stream through 38 to control the buildup of solid materials in the hydroconversion reactor, and the balance of the slurry is returned by line 40 and line 30 to hydroconversion reactor 22. The purge stream may be filtered subsequently to recover catalyst and liquid product or it can be burned or gasified to provide, respectively, heat and hydrogen for the process.

In the process option to be designated "B", the purge stream from concentration zone 34 is omitted and the entire slurry concentrate withdrawn through line 40 is fed to separation zone 44 via lines 30 and 42. In this zone, a major portion of the remaining liquid phase is separated from the solids by means of centrifugation, filtration or a combination of settling and drawoff, etc. Liquid is removed from the zone through line 46 and solids through line 48. At least a portion of the solids and associated remaining liquid are purged from the process via line 50 to control the buildup of solids in the process and the balance of the solids are recycled to hydroconversion reactor 22 via line 52 which connects to recycle line 30. The solids can be recycled either as recovered or after suitable cleanup (not shown) to remove heavy adhering oil deposits and coke.

In option designated "C", the slurry of solids in oil exiting from separator 26 via line 30 is fed directly to separation zone 44 by way of line 42 whereupon solids and liquid product are separated by means of centrifugation or filtration. All or part of the solids exiting from vessel 44 via line 48 may be purged from the process through line 50 and the remainder recycled to the hydroconversion reactor. Liquid product is recovered through line 46. If desired, at least a portion of the heavy fraction of the hydroconverted oil product may be recycled to the hydroconversion zone.

The process of the invention may be conducted either as batch or as a continuous type process.

The following examples are presented to illustrate the invention.

EXAMPLE 1

Figure 3:
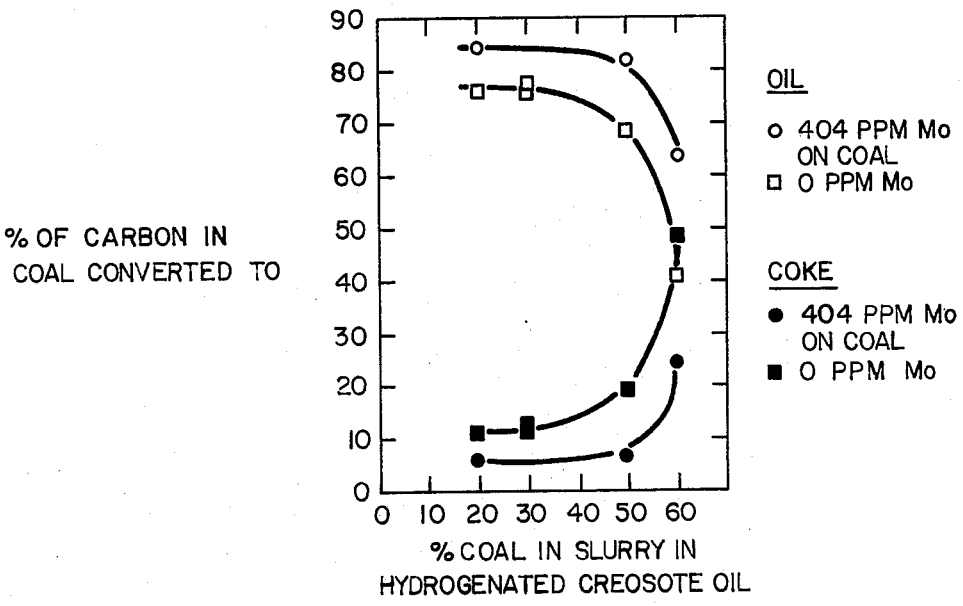
FIG. 3 is a graph comparing catalyzed versus non-catalyzed runs.

A series of experiments was conducted in which the effectiveness of molybdenum naphthenate for producing coal liquids, versus coke, at various coal slurry concentrations compared to thermal noncatalyzed hydrogen donor solvent liquefaction was determined. The conditions for these experiments were 820° F. (437.7° C.), 1 hour, 2000+ psig hydrogen utilizing hydrogenated creosote oil as hydrogen donor solvent. The results of these experiments are plotted in FIG. 3. Molybdenum naphthenate was used as the catalyst precursor.

EXAMPLE 2

A series of experiments was conducted utilizing molybdenum naphthenate and a partially hydrogen depleted noncatalyzed hydrogen donor solvent at a temperature of 820° F. (437.7° C.) for 60 minutes and with 2000+ psig hydrogen pressure. The results of these runs are summarized in Table I.

TABLE I

HYDROGENATION OF HDS UNDER LIQUEFACTION CONDITIONS

| 820° F., 60 Min., 2000+ psig $H_2$ | | |
|---|---|---|
| Run No. | 149 | 148 |
| Catalyst Precursor | | |
| Name | Mo Naphthenate | None |
| Wt. ppm Mo | 404 | — |
| Charge | | |
| H/C Ratio | 1.098 | 1.098 |
| % Tetralin | 75 | 75 |
| % Naphthalene | 25 | 25 |
| Product | | |
| H/C Ratio | 1.149 | 1.092 |
| % Tetralin | 87 | 73 |
| % Naphthalene | 13 | 27 |

This series of experiments shows that hydrogen depleted donor solvent is rehydrogenated in the presence of the catalyst, whereas in the thermal noncatalyzed process, it is not rehydrogenated.

EXAMPLE 3

Figure 4:
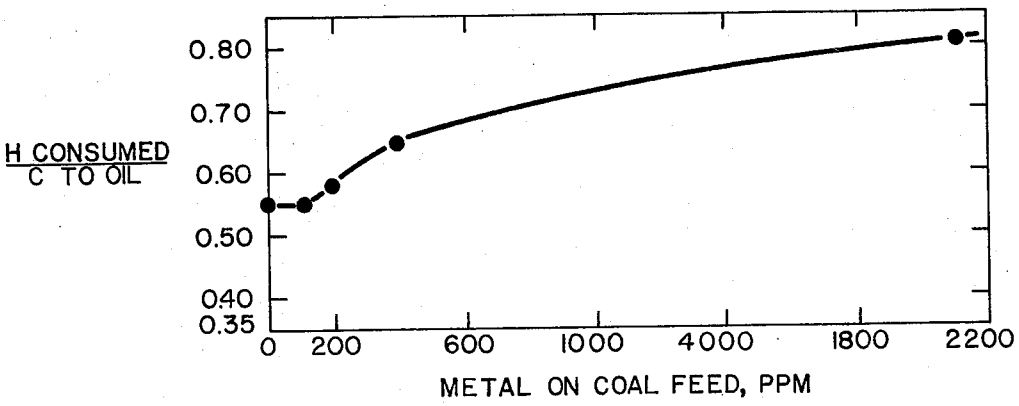
FIG. 4 is a graph showing hydrogen consumption at various catalyst concentrations.

To determine the hydrogen consumption, experiments were conducted at 820° F. (437.7° C.), 1 hour, 2000+ psig hydrogen pressure with a slurry containing 50 wt. % of 200 mesh dry Wyodak coal and 50 wt. % tetralin with a molybdenum naphthenate catalyst. Results of these tests are plotted in FIG. 4. Hydrogen consumption (determined by measuring hydrogen feed and measuring and analyzing product gases) showed that these catalysts enhance the absorption of hydrogen in the reactor and thereby maintain the hydrogen donor solvent in hydrogenated form.

EXAMPLE 4

Tests were conducted with various metal catalysts in hydrogen donor solvent. Conditions were 725° F. (385° C.) pretreat, 30 minutes, 820° F. (437.7° C.) reaction temperature, 60 minutes, with 2000+ psig hydrogen pressure utilizing 50 wt. % of 200 mesh Wyodak coal, that is, 46 grams of coal and 46 grams of solvent. Results of these tests are summarized in Table II.

Run 113 is a thermal liquefaction in which no soluble metal compound was added.

Runs 125, 114, 115, 111, 124, 126 and 129 are similar runs except that soluble molybdenum compounds were added in small amounts. In these experiments, in comparison with run 113, coke yield was greatly reduced and conversion of coal to oil was greatly improved and hydrogen adsorption in the hydroconversion reaction was increased.

Run 128 is a hydroconversion reaction in which wet coal is reacted with a hydrogen-carbon monoxide mixture in the presence of added molybdenum naphthenate. Analyses showed that more than 50% of the CO reacted with water to form $CO_2$ and additional hydrogen which aided in the liquefaction. An even lower coke yield (4.7%) was obtained than the equivalent run with pure hydrogen and dry coal, run 115 (5.8% coke yield).

EXAMPLE 5

Other sets of experiments were conducted with and without pretreatment. The results are summarized in Table III.

Comparison of run 151 versus 154 shows that with molybdenum added as molybdenum naphthenate directly to the hydroconversion reaction, i.e. without pretreatment, excellent catalytic hydroconversion is obtained.

Comparison of run 150 versus 151 shows a slight improvement in oil and coke yields when a hydrogen pretreatment is given.

Comparison of run 152 versus 150 shows that phosphomolybdic acid gives even better oil yield and lower coke yield than molybdenum naphthenate.

TABLE II

CATALYZED HYDROGEN DONOR SOLVENT COAL LIQUEFACTION

50 Wt. % 200 Mesh Wyodak
725° F. Pretreat, 30 Min.
820° F. Reaction, 60 Min.
2000+ psig $H_2$
Charge 46.0 g. Coal, 46.0 g. Solvent

| Run No. | 113 | 125 | 114 | 115 | 111 | 124 | 126 | 128 | 129 |
|---|---|---|---|---|---|---|---|---|---|
| Catalyst Precursor Name | None | Mo Naphthenate | Mo Naphthenate | Mo Naphthenate | Mo Naphthenate | Mo Naphthenate | $MoCl_5$ | Mo Naphthenate | Mo Naphthenate |
| Wt. ppm Metal on Coal | — | 104 | 196 | 391 | 2142 | 2142 | 916 | 391 | 391 |
| HDS[1] | Tetralin | Tetralin | Tetralin | Tetralin | Tetralin | Tetralin | Tetralin | Tetralin | Hydrogenated Cresote Oil |
| Coal Wet or Dry | Dry* | Dry* | Dry* | Dry* | Dry* | Wet | Dry* | Wet | Dry* |
| Pretreat Gas | $H_2$ | $H_2$ | $H_2$ | $H_2$ | $H_2$ | $H_2$ | $H_2$ | 83.8% $H_2$** 16.2% CO | $H_2$ |
| Carbon Disposition, Mole % of Carbon in Coal Feed | | | | | | | | | |

TABLE II-continued

CATALYZED HYDROGEN DONOR SOLVENT COAL LIQUEFACTION

50 Wt. % 200 Mesh Wyodak
725° F. Pretreat, 30 Min.
820° F. Reaction, 60 Min.
2000+ psig $H_2$
Charge 46.0 g. Coal, 46.0 g. Solvent

| | | | | | | | | | |
|---|---|---|---|---|---|---|---|---|---|
| Oil | 64.3 | 80.4 | 84.3 | 85.0 | 86.9 | 86.2 | 87.0 | 84.7 | 89.5 |
| $C_1$ hydrocarbons | 2.3 | 2.4 | 2.0 | 2.0 | 2.0 | 2.0 | 1.9 | 2.1 | 1.7 |
| $C_2$ + " | 3.0 | 2.9 | 2.8 | 2.7 | 2.8 | 3.2 | 2.8 | 3.0 | 2.3 |
| Coke**** | 25.3 | 9.3 | 6.2 | 5.8 | 4.2 | 3.4 | 3.7 | 4.7 | 3.6 |
| CO | 1.0 | 0.8 | 0.9 | 0.9 | 0.5 | 0.2 | 0.7 | 5.5 | 0.8 |
| $CO_2$ | 4.1 | 4.2 | 3.8 | 3.6 | 3.6 | 5.0 | 3.9 | | 2.1 |
| $H_2$ Consumed, Moles | 0.4389 | 0.5560 | 0.6054 | 0.6921 | 0.8711 | 0.8081 | 0.8071 | 0.6803*** | 0.6064 |

| Run No. | 117 | 130 | 183 |
|---|---|---|---|
| Catalyst Precursor Name | V Resinate | V Resinate | Cr Resinate |
| Wt. ppm Metal on Coal | 398 | 398 | 396 |
| HDS[1] | Tetralin | Tetralin | Hydrogenated |
| Coal Wet or Dry | Dry* | Dry* | Wet |
| Pretreat Gas | $H_2$ | 87% $H_2$ 13% $H_2S$ | 87% $H_2$ 13% $H_2S$ |
| Carbon Disposition, Mole % of Carbon in Coal Feed | | | |
| Oil | 71.6 | 88.7 | 88.7 |
| $C_1$ hydrocarbons | 2.1 | 1.9 | 2.2 |
| $C_2$ + hydrocarbons | 2.8 | 2.4 | 3.1 |
| Coke**** | 18.7 | 6.0 | 4.9 |
| CO | 0.9 | — | — |
| $CO_2$ | 3.9 | — | — |
| $H_2$ Consumed, Moles | 0.4758 | 0.4309 | 0.5970 |

*Dried 24 hrs. at 186° C. and oil pump pressure.
**Both for pretreat and for run.
***Includes 0.0939 mole ffrom conversion of CO to $CO_2$.
****Toluene insoluble carbonaceous material.
[1]HDS means hydrogen donor solvent.

TABLE III

HYDROGEN DONOR SOLVENT COAL LIQUEFACTION

820° F., 60 min.
2000+ psig $H_2$

| Run No. | 150 | 151 | 152 | 154 |
|---|---|---|---|---|
| Catalyst Precursor Name | Mo naphthenate | Mo naphthenate | Phosphomolybdic Acid | None |
| Wt. ppm Metal, on coal | 404 | 404 | 378 | — |
| HDS[1] | 46.0 g. Hydrogenated creosote oil | 46.0 g. Hydrogenated creosote oil | 46.0 g. Hydrogenated creosote oil | 46.0 g. Hydrogenated creosote oil |
| Coal | 46.0 g. 200 Mesh Wet Wyodak Coal | 46.0 g. 200 Mesh Wet Syodak Coal | 46.0 g. 200 Mesh Wet Syodak Coal | 46.0 g. 200 Mesh Wet Wyodak Coal |
| Pretreat | | | | |
| Gas | $H_2$ | — | $H_2$ | — |
| Temp. °]F. | 725 | — | 725 | — |
| Time, Min. | 30 | — | 30 | — |
| Carbon Disposition Mole % of Carbon in Coal Feed | | | | |
| Oil | 83.3 | 81.7 | 86.3 | 68.5 |
| $C_1$ | 2.4 | 2.8 | 2.4 | 2.8 |
| $C_2$ + $C_3$ | 3.1 | 3.4 | 3.0 | 3.2 |
| Coke | 5.8 | 6.2 | 3.1 | 19.4 |
| CO | 0.7 | 0.9 | 0.7 | 0.7 |
| $CO_2$ | 4.7 | 5.0 | 4.5 | 5.4 |
| $H_2$ Consumed Moles | 0.7026 | 0.6526 | 0.6756 | .3881 |

[1]HDS means hydrogen donor solvent

EXAMPLE 6

Experiments were conducted in which solids recovered from the catalyzed hydrogen donor solvent coal liquefaction process of this invention were utilized as catalysts compared to molybdenum naphthenate. No pretreatment was made prior to conducting these runs. Results of these experiments are summarized in Table IV.

As can be seen from Table IV, the recycled solids were more effective than the fresh molybdenum naphthenate catalyst in reducing coke and maximizing liquid yield.

TABLE IV

EFFECTIVENESS OF RECYCLE SOLIDS IN CATALYZED HDS* COAL LIQUEFFACTION

820° F., 1 Hr., 2000+ psig $H_2$
50% Slurry of 200 Mesh Wet Wyodak in Hydrogenated Creosote Oil

| Run No. | 151 | 164 |
|---|---|---|
| Catalyst or Precursor Name | Mo Naphthenate | Solids From Run 151 |
| Mo Conc., ppm, on coal | 404 | 396 |

TABLE IV-continued

| EFFECTIVENESS OF RECYCLE SOLIDS IN CATALYZED HDS* COAL LIQUEFACTION | | |
|---|---|---|
| Yields of Products, % Feed Coal Carbon Converted to | | |
| $C_1$-$C_3$ hydrocarbons | 6.2 | 5.4 |
| $CO + CO_2$ | 5.9 | 5.6 |
| Coke | 6.2 | 0.7 |
| Liquid | 81.7 | 88.3 |

*HDS - hydrogen donor solvent

EXAMPLE 7

A set of experiments was carried out to determine the effect of $H_2S$ on molybdenum catalyzed hydrogen donor solvent coal liquefaction when the hydrogen sulfide was added in pretreatment and when it was added to the hydroconversion (liquefaction) reaction. Results of these experiments are summarized in Table V.

Comparison of run 207 versus run 203 shows that a slight improvement in oil and coke yields are obtained when $H_2S$ is added to the hydroconversion reaction Comparison of run 187 versus runs 202 and 203 shows that a greater improvement in oil and coke yield occurs when $H_2S$ is added to the pretreatment step, and an even lower Conradson carbon products is obtained.

Comparison of run 217, in which a mixture of an inert gas (i.e. nitrogen) and hydrogen sulfide was utilized in the pretreatment, versus run 187, in which a mixture of hydrogen and hydrogen sulfide was used in the pretreatment, shows that greater improvement in oil yield and coke suppression occurs when the gaseous mixture contains hydrogen and hydrogen sulfide.

TABLE V $H_2S$ EFFECT ON CATALYZED HDS* COAL LIQUEFACTION 400 ppm Mo on coal added as naphthenate
50/50 Wyodak/Hydrogenated Creosote Oil
820° F., 1 hr., 2000+ psig $H_2$

| Run No. | 203 | 207 | 202 | 217 | 187 |
|---|---|---|---|---|---|
| Pretreat | | | | | |
| Temp., ° F. | — | — | 725 | 725 | 725 |
| Time, Min. | — | — | 30 | 30 | 30 |
| Gas | — | — | $H_2$ | 13% $H_2S$/ | 13% $H_2S$/ |
| Treat Gas | $H_2$ | 8% $H_2S$/ $H_2$ | $H_2$ | $H_2$ | $H_2$ |
| Yields, Mole % C to | | | | | |
| $CO + CO_2$ | 5.7 | 5.0 | 6.0 | 5.6 | 6.0 |
| $C_1$-$C_3$ Hydrocarbon | 5.7 | 6.1 | 4.9 | 6.2 | 4.2 |
| Oil | 83.0 | 84.6 | 84.2 | 83.2 | 87.1 |
| Coke | 5.5 | 4.2 | 4.9 | 5.0 | 2.7 |
| Liquid Analyses (Incl. Solvent) | | | | | |
| S, % | 0.08 | 0.30 | 0.09 | 0.29 | 0.20 |
| Ni, ppm | 2 | 1 | 2 | 1 | 1 |
| Fe, ppm | 2 | 1 | 0 | 0 | 9 |
| V, ppm | 0 | 0 | 1 | 0 | 0 |
| Mo, ppm | 0.0 | <0.4 | 0.8 | — | — |
| Con. Carbon | 11.0 | 7.2 | 10.8 | 11.0 | 5.8 |

*HDS - hydrogen donor solvent

What is claimed is:

1. A process for hydroconverting coal to produce an oil, which comprises the steps of:

(a) forming a mixture of coal, a hydrogen donor solvent comprising at least 30 weight percent of hydrogen donor compounds and an added oil-soluble metal compound, said metal being selected from the group consisting of Groups VB, VIB, VIIB and VIII of the Periodic Table of Elements and mixtures thereof;

(b) converting said oil-soluble compound to a catalyst within said mixture in the presence of a hydrogen-containing gas by heating said mixture to an elevated temperature;

(c) reacting the resulting mixture containing said catalyst with hydrogen under coal hydroconversion conditions, in a hydroconversion zone;

(d) removing from said hydroconversion zone an effluent comprising an oil product and solids;

(e) separating said oil product into at least a light fraction, an intermediate fraction and a heavy fraction; and (f) recycling, without intervening hydrogenation, at least a portion of said intermediate fraction as solvent to said hydroconversion zone.

2. The process of claim 1 wherein said oil soluble metal compound in step (a) is added in an amount ranging from about 10 to less than 2000 weight parts per million, calculated as the elemental metal, based on the weight of the coal in said mixture.

3. The process of claim 1 wherein said oil soluble metal compound is selected from the group consisting of inorganic compounds, salts of organic acids, organometallic compounds and salts of organic amines.

4. The process of claim 1 wherein said oil soluble metal compound is selected from the group consisting of salts of acyclic aliphatic carboxylic acids and salts of alicyclic aliphatic carboxylic acids.

5. The process of claim 1 wherein said oil soluble metal compound is a salt of naphthenic acid.

6. The process of claim 1 wherein the metal constituent of said oil soluble metal compound is selected from the group consisting of molybdenum, chromium and vanadium.

7. The process of claim 1 wherein said oil soluble metal compound is molybdenum naphthenate.

8. The process of claim 1 wherein said hydrogen-containing gas of step (b) comprises from about 1 to 90 mole percent hydrogen sulfide.

9. The process of claim 1 wherein said hydrogen-containing gas of step (b) comprises from about 1 to 50 mole percent hydrogen sulfide.

10. The process of claim 1 wherein said oil soluble metal compound is converted to a catalyst by subjecting said mixture to a temperature range selected from the group consisting of a temperature ranging from about 343° C. to about 538° C. in said hydroconversion zone maintained under hydroconversion conditions and a temperature ranging from about 325° to about 415° C. prior to said hydroconversion step.

11. The process of claim 1 wherein said oil soluble metal compound is converted by first heating the mixture of said soluble metal compound, coal and hydrogen donor solvent to a temperature ranging from about 325° C. to about 415° C. in the presence of said hydrogen-containing gas to form a catalyst within said mixture and subsequently reacting the resulting mixture containing the catalyst with hydrogen under hydroconversion conditions.

12. The process of claim 11 wherein said hydrogen-containing gas also contains hydrogen sulfide.

13. The process of claim 1 wherein said oil soluble metal compound is converted in the presence of a hydrogen containing gas in the hydroconversion zone under hydroconversion conditions thereby forming said catalyst in situ within said mixture in the hydroconversion zone.

14. The process of claim 1 wherein said hydroconversion conditions include a temperature ranging from about 343° C. to about 538° C. (649.4° to 1000° F.) and a hydrogen partial pressure ranging from 500 to 5000 psig.

15. The process of claim 1 wherein the space velocity of said mixture in said hydroconversion zone ranges from about 0.1 to 10 volumes of mixture per hour per volume of hydroconversion zone.

16. The process of claim 1 comprising the additional steps of separating at least a portion of said solids from said hydroconversion zone effluent and recycling at least a portion of said separated solids to said hydroconversion zone.

17. The process of claim 1 wherein said catalyst is the sole catalyst in said hydroconversion zone.

18. The process of claim 1 wherein said solvent and coal are mixed in a solvent-to-coal weight ratio ranging from about 0.8:1 to about 4:1.

19. The process of claim 1 wherein said solvent and coal are mixed in a solvent-to-coal weight ratio ranging from about 1:1 to 2:1.

20. The process of claim 1 wherein said oil soluble metal compound is converted to a catalyst by subjecting said mixture to a temperature ranging from about 343° to about 538° C. in said hydroconversion zone under hydroconversion conditions.

21. A process for hydroconverting coal to produce an oil product, which comprises:

(a) forming a mixture of coal, hydrogen donor solvent and an oil soluble metal compound, said compound being added in an amount ranging from about 10 to less than 2000 weight parts per million, calculated as the elemental metal, based on the weight of the coal in said mixture, said metal being selected from the group consisting of Groups VB, VIB, VIIB and VIII of the Periodic Table of Elements and mixtures thereof;

(b) heating the mixture resulting from step (a) to a temperature ranging from about 325° C. to about 415° C. in the presence of a hydrogen-containing gas to form a catalyst within said mixture;

(c) reacting the resulting mixture containing said catalyst with hydrogen under hydroconversion conditions including a temperature ranging from about 343° C. to about 538° C. (649.4° F. to 1000° F.) and a hydrogen pressure ranging from about 500 to about 5000 psig;

(d) removing from said hydroconversion zone an effluent comprising an oil product and solids;

(e) separating said oil product into at least a light fraction, an intermediate fraction and a heavy fraction; and (f) recycling, without intervening hydrogenation, at least a portion of said intermediate fraction as solvent to said hydroconversion zone.

22. A process for hydroconverting coal to produce an oil, which comprises the steps of:

(a) forming a mixture of wet coal, a hydrogen donor solvent comprising at least 30 weight percent of hydrogen donor compounds and an added oil-soluble metal compound, said oil soluble compound being added in an amount ranging from about 10 to about 700 wppm, calculated as the elemental metal, based on the coal in said mixture, said metal being selected from the group consisting of Groups VB, VIB, VIIB and VIII of the Periodic Table of Elements and mixtures thereof;

(b) converting said oil-soluble compound to a catalyst within said mixture in the presence of a hydrogen-containing gas by heating said mixture to be an elevated temperature;

(c) reacting the resulting mixture containing said catalyst with a gas comprising hydrogen and from about 5 to about 50 mole percent carbon monoxide, under coal hydroconversion conditions, in a hydroconversion zone; and (d) recovering an oil product.

23. The process of claim 22 wherein said oil soluble metal compound is added to step (a) in an amount ranging from about 50 to 500 wppm, calculated as the elemental metal, based on the coal.

24. The process of claim 22 wherein said oil soluble metal compound is a metal-containing organic compound.

25. The process of claim 22 wherein said oil soluble metal compound is a molybdenum-containing organic compound.

26. A process for hydroconverting coal to produce an oil, which comprises the steps of:

(a) forming a mixture of wet coal, a hydrogen donor solvent comprising at least 30 weight percent of hydrogen donor compounds and an added oil-soluble molybdenum-containing organic compound, said organic compound being added in an amount ranging from about 10 to less than 2000 wppm, calculated as the elemental metal, based on the coal in said mixture;

(b) converting said organic compound to a catalyst within said mixture in the presence of a hydrogen-containing gas by heating said mixture to an elevated temperature;

(c) reacting the resulting mixture containing said catalyst with a gas comprising hydrogen and from about 5 to about 50 mole percent carbon monoxide, under coal hydroconversion conditions; and (d) recovering an oil product.

27. The process of claim 26 wherein said organic compound is selected from the group consisting of salts or organic acids, organometallic compounds and salts of organic amines.

28. The process of claim 26 wherein said organic compound is selected from the group consisting of salts of acyclic aliphatic carboxylic acids and salts of alicyclic aliphatic carboxylic acids.

29. The process of claim 26 wherein said organic compound is molybdenum naphthenate.

30. The process of claim 26 wherein said hydrogen containing gas of step (b) comprises from about 1 to 90 mole percent hydrogen sulfide.

31. The process of claim 26 wherein the gas of step (c) additionally comprises from about 1 to about 30 mole percent hydrogen sulfide.

* * * * *